US009415958B2

(12) United States Patent
Kubota et al.

(10) Patent No.: US 9,415,958 B2
(45) Date of Patent: Aug. 16, 2016

(54) DRAWING APPARATUS

(75) Inventors: Hitoshi Kubota, Tokyo (JP); Daijiro Kato, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 358 days.

(21) Appl. No.: 13/563,492

(22) Filed: Jul. 31, 2012

(65) Prior Publication Data

US 2013/0032996 A1 Feb. 7, 2013

(30) Foreign Application Priority Data

Aug. 5, 2011 (JP) ..... 2011-171999

(51) Int. Cl.
*A47B 95/00* (2006.01)
*B65H 1/26* (2006.01)

(52) U.S. Cl.
CPC ..... *B65H 1/266* (2013.01); *B65H 2402/515* (2013.01); *B65H 2402/546* (2013.01); *B65H 2402/60* (2013.01); *B65H 2405/31* (2013.01); *B65H 2511/20* (2013.01); *B65H 2601/10* (2013.01); *B65H 2801/06* (2013.01)

(58) Field of Classification Search
CPC ..... A47B 88/047; A47B 88/0477; A47B 88/0481
USPC ..... 312/333, 332.1, 215–222; 271/264, 145
See application file for complete search history.

(56) References Cited

U.S. PATENT DOCUMENTS

| | | | | |
|---|---|---|---|---|
| 1,053,765 | A * | 2/1913 | Wren | 292/19 |
| 1,917,740 | A * | 7/1933 | Strand | 16/85 |
| 1,931,695 | A * | 10/1933 | Hall | 292/17 |
| 1,973,971 | A * | 9/1934 | West | 292/76 |
| 2,556,612 | A * | 6/1951 | Buntin | 312/334.12 |
| 4,182,539 | A * | 1/1980 | Busch | 312/333 |
| 5,711,554 | A * | 1/1998 | Brown et al. | 292/19 |
| 6,595,605 | B1 * | 7/2003 | Babcock et al. | 312/223.2 |
| 7,469,892 | B2 * | 12/2008 | Iwase et al. | 271/164 |
| 7,686,353 | B2 * | 3/2010 | Lewis et al. | 292/19 |
| 8,374,661 | B2 * | 2/2013 | Fratti et al. | 455/575.6 |
| 8,540,328 | B2 * | 9/2013 | Chen et al. | 312/333 |
| 2004/0119297 | A1 * | 6/2004 | Bella et al. | 292/300 |
| 2006/0103279 | A1 * | 5/2006 | Lai | 312/333 |
| 2010/0277047 | A1 * | 11/2010 | Sung | 312/333 |
| 2010/0314981 | A1 * | 12/2010 | Koenig et al. | 312/333 |

FOREIGN PATENT DOCUMENTS

| | | | |
|---|---|---|---|
| JP | S62-131345 | U | 8/1987 |
| JP | 2004-274465 | A | 9/2004 |
| JP | 2006-151687 | A | 6/2006 |
| JP | 2008-127110 | A | 6/2008 |
| JP | 2011-037629 | A | 2/2011 |

* cited by examiner

*Primary Examiner* — Daniel J Troy
*Assistant Examiner* — Timothy M Ayres
(74) *Attorney, Agent, or Firm* — Canon USA Inc. IP Division

(57) ABSTRACT

An image forming apparatus is provided that can surely position a unit in an apparatus body with a simple configuration where the number of components is small. A drawing apparatus, which draws a sheet feeding cassette as a unit to a predetermined position of the apparatus body to position it, includes : a leaf spring that is an elastic member to jump-buckle; an engaging unit disposed in the leaf spring; and an engaged unit engaged with the engaging unit. When the unit is loaded on the apparatus body, the engaging unit engages the engaged unit, the elastic member jump-buckles, and accordingly the unit is drawn to the predetermined position of the apparatus body.

18 Claims, 16 Drawing Sheets

DRAWING APPARATUS

BACKGROUND OF THE INVENTION

1. Field of the Invention

The present disclosure relates to a drawing apparatus and an image forming apparatus that includes the same. More particularly, the disclosure relates to a drawing apparatus that draws a unit into an apparatus body, and an image forming apparatus that includes the same.

2. Description of the Related Art

Conventionally, an image forming apparatus such as a printer for forming an image on a sheet includes a unit mountable or drawable to and from a forming apparatus body (hereinafter, referred to as an apparatus body). As such units, for example, there are a sheet feeding cassette for receiving sheets, a sheet feeding device (sheet feeding unit) for feeding the sheets from the sheet feeding cassette, and an image forming unit (transfer unit or fixing unit) for forming images on the sheets.

When, after the units have been pulled out from the apparatus body, a user manually pushes the units into the apparatus body to load them on the apparatus body, sometimes the units may not be pushed and positioned into a loading completion position that is a predetermined position of the apparatus body. In the image forming apparatus, when the units are not set in the loading completion position of the apparatus body, various problems occur.

For example, when such a unit is a sheet feeding cassette, since a sheet is not in an appropriate position, an image may not be accurately formed on the sheet or a sheet feeding failure (skewed feeding or jamming of the sheet) may occur. When the unit is a transfer unit for transferring an image to the sheet, a position of the image may not be transferred to a correct position of the sheet, consequently causing an image quality failure.

Therefore, such units must accurately be positioned and loaded on the image forming apparatus.

Japanese Patent Application Laid-Open No. 2006-151687 discusses an image forming apparatus that includes a drawing mechanism for positioning a unit onto an apparatus body by using a toggle mechanism.

As illustrated in FIG. 15, a drawing apparatus 101 discussed in Japanese Patent Application Laid-Open No. 2006-151687 includes a toggle arm 106 configured to move around a swing shaft 107. At the swinging end of the toggle arm 106, a locking groove 106*a* is formed to lock a locking pin 102 of a sheet feeding cassette. Further, a toggle spring 108 is hung between a shaft 110 disposed in an apparatus body 51 and a shaft 109 disposed on the toggle arm 106 side. The drawing apparatus 101 further includes a guiding member 111 disposed to lock and guide the locking pin 102.

When the sheet feeding cassette is inserted into an accommodating unit 1B of the apparatus body 51, as illustrated in FIG. 16, the locking pin 102 of the sheet feeding cassette is locked into the locking groove 106*a* of the toggle arm 106, and the sheet feeding cassette is drawn to a sheet feedable position by the drawing apparatus 101.

A pressing direction of a spring force applied by the toggle spring 108 is reversed from a clockwise direction to an anticlockwise direction at a neutral point. Before its insertion, the sheet feeding cassette stands by in a position near the neutral point, in a slightly shifted phase from the neutral point, and is pressed in the clockwise direction.

Then, when after the insertion of the sheet feeding cassette, the locking pin 102 is locked in the locking groove 106*a* of the toggle arm 106, and the toggle arm 106 is swung beyond the neutral point, the pressing force of the toggle spring 108 is revered in the anticlockwise direction, and the cassette is drawn into the apparatus body.

However, the drawing apparatus using the toggle mechanism needs the swinging member for changing the direction of the pressing force applied by the toggle spring and the guiding member for guiding the locking member locked in the swinging member.

Specifically, the drawing apparatus using the toggle mechanism illustrated in FIG. 16 needs the toggle spring 108, the toggle arm 106 for grabbing the locking pin 102 to draw the sheet feeding cassette, and the guiding member 111 for guiding the locking pin 102 locked in the locking groove 106*a* of the toggle arm 106.

However, greater cost reduction is demanded for the recent image forming apparatus. There is a demand for an apparatus small in a number of components, simple in configuration, and capable of surely positioning units in an apparatus body.

SUMMARY OF THE INVENTION

The present disclosure is directed to an image forming apparatus small in a number of components, simple in configuration, and capable of surely positioning units in an apparatus body.

According to an aspect disclosed herein, a drawing apparatus for drawing a unit loadable to and pullable from an apparatus body into a predetermined position of the apparatus body, includes: an elastic member disposed in one of the apparatus body and the unit and configured to jump-buckle; an engaging unit disposed in the elastic member; and an engaged unit disposed in another of the apparatus body and the unit and configured to engage with the engaging unit. When the unit is loaded on the apparatus body, the engaging unit engages with the engaged unit, the elastic member is configured to jump-buckle, and accordingly the unit is drawn to the predetermined position of the apparatus body.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles as disclosed herein.

DESCRIPTION OF THE EMBODIMENTS

Various exemplary embodiments, features, and aspects of the disclosure will be described in detail below with reference to the drawings.

Figure 5A:
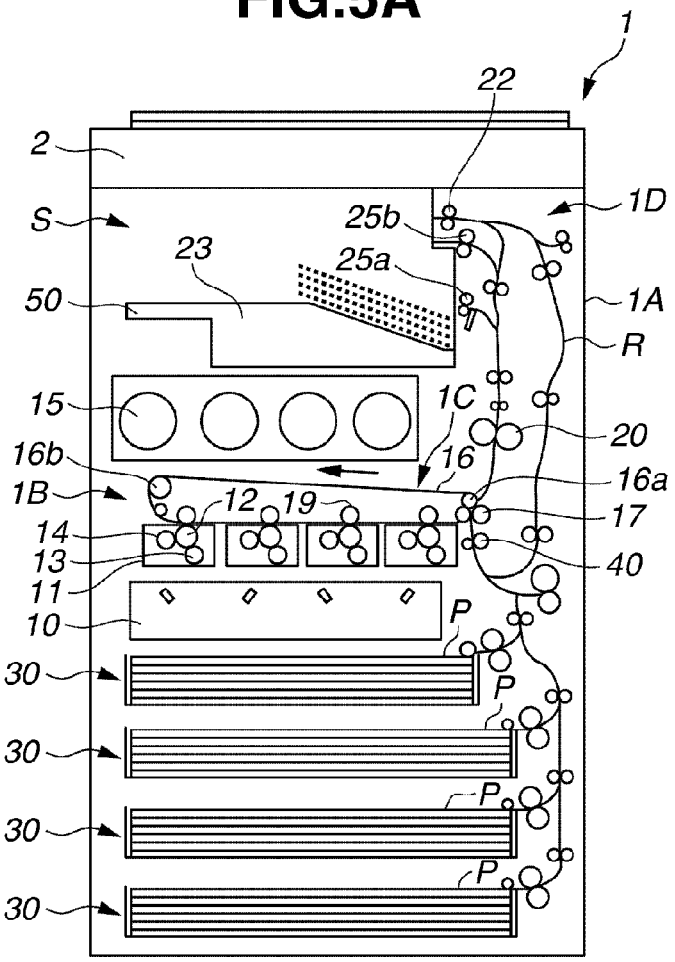
FIGS. 5A and 5B illustrate an image forming apparatus to which the drawing apparatus of the present disclosure is applied.
Figure 5B:
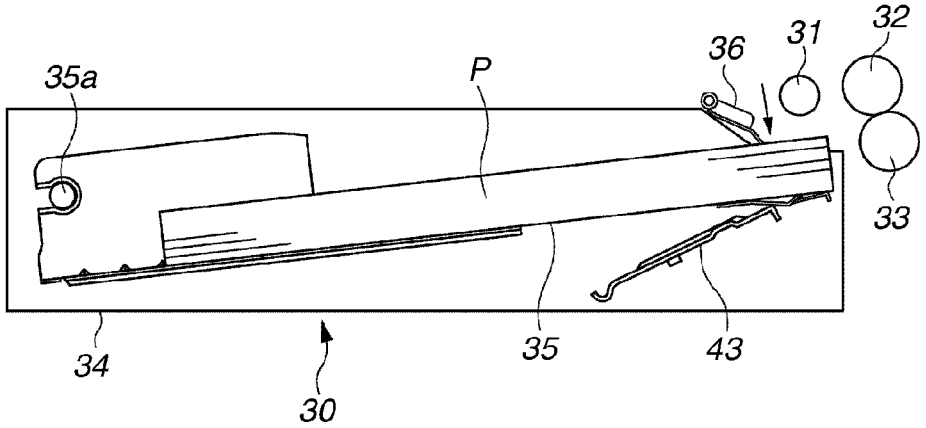
Figure 6:
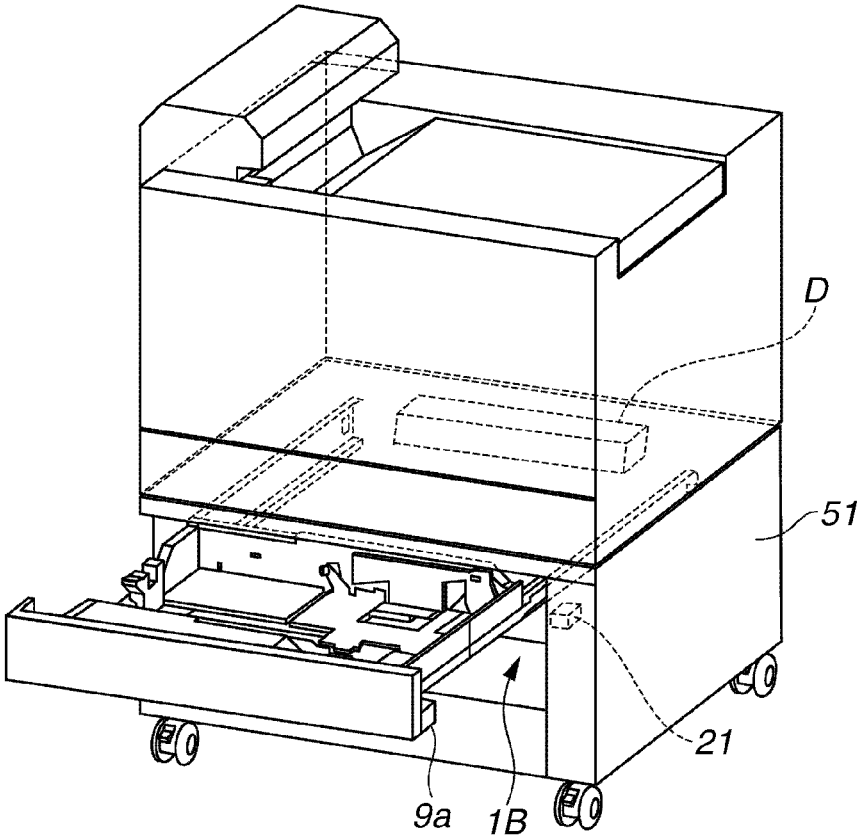
FIG. 6 is a perspective view illustrating the image forming apparatus illustrated in FIGS. 5A and 5B.

FIG. 5A illustrates an overall configuration of an image forming apparatus to which a drawing apparatus of the present disclosure is applied. FIG. 5B is a sectional view illustrating a sheet feeding cassette 9 included in the image forming apparatus. FIG. 6 is a perspective view illustrating the image forming apparatus.

In FIG. 5A, a full-color laser beam printer (hereinafter, printer) 1 includes an image forming apparatus body (printer body) 1A, an image forming unit 1B that forms an image on a sheet, and a fixing unit 20. An image reading apparatus 1 is an upper apparatus installed roughly horizontally on the apparatus body 1A. A sheet discharge space S to discharge sheets is formed between the image reading apparatus 2 and the apparatus body 1A. The printer 1 further includes a toner cartridge 15.

The image forming apparatus 1B includes a process cartridge 11. The process cartridge 11 includes a photosensitive drum 12, a charger 13 that is a charging unit, and a developing device 14 that is a developing unit. An intermediate transfer unit 1C is disposed on the process cartridge 11.

By applying a transfer bias of a positive polarity to an intermediate transfer belt 16 by a primary transfer roller 19, a toner image having a negative polarity, on the photosensitive drum is transferred to the intermediate transfer belt 16. In a position facing a driving roller 16*a* of the intermediate transfer belt 1C, a secondary transfer roller 17 constituting a secondary transfer unit for transferring a color image formed on the intermediate transfer belt to a sheet P is disposed. Further, the fixing unit 20 is disposed above the secondary transfer roller 17.

Next, an image forming operation of the printer 1 thus configured is described. First, after the image reading apparatus 2 has read image information of a document, this image information is processed, and then converted into an electric signal to be transmitted to a laser scanner 10 of the image forming unit 1B. The image information may be input to the image forming unit 1B from an external device such as a personal computer.

Then, at the image forming unit 1B, a surface of the photosensitive drum 12 of each process cartridge 11 is scanned with a laser beam emitted from the laser scanner 10. Accordingly, the surfaces of the photosensitive drums 12 uniformly charged to a predetermined polarity/potential by the charger 13 are sequentially exposed, and electrostatic latent images are sequentially formed on the photosensitive drums of the process cartridges 11.

Then, the electrostatic latent images are developed by color toner to be visible, and color images on the photosensitive drums are sequentially superimposed and transferred onto the intermediate transfer belt 16 by a primary transfer bias applied to the primary transfer roller 19. As a result, a toner image is formed on the intermediate transfer belt 16.

Simultaneously with the toner image forming operation, the sheet P is fed from a sheet feeding device 30. As illustrated in FIG. 5B, the sheet feeding device 30 is configured to feed sheets from a sheet P feeding cassette 9 including a sheet stacking plate 35 for stacking the sheets P. The sheets are fed to a separation-conveyance roller pair including a conveyance roller 32 and a separation roller 33, by a sheet feeding roller 31 for picking up an uppermost sheet. Because the number of sheets decreases along with feeding of the sheets P, the sheet staking plate 35 is controlled to raise a sheet surface to a sheet feedable height.

When it is detected by a sheet presence detection sensor 36 that there is no more sheet to be fed, the sheet feeding operation is stopped, and sheet replenishment is urged on a panel display. When there is no more sheet stored in the sheet feeding cassette 9, a user pulls out the sheet feeding cassette 9, and replenishes the sheet feeding cassette 9 with new sheets to store them in the cassette.

Then, the sheet P is conveyed from a registration roller pair 40 to the secondary transfer unit. Then, at the secondary transfer unit, a toner image is transferred onto the sheet P by a secondary transfer bias applied to the secondary transfer roller 17. The sheet P on which the toner image has been transferred is then conveyed to the fixing unit 20. At the fixing unit 20, the sheet P receives heat and pressure to fix the toner image as a color image thereon. The sheet P having the image fixed thereon is discharged to the discharge space S by a first discharge roller pair 25*a* disposed on the downstream side of the fixing unit 20, and projected from the bottom surface of the discharge space S to be stacked on a stacking unit 23.

Figure 1:
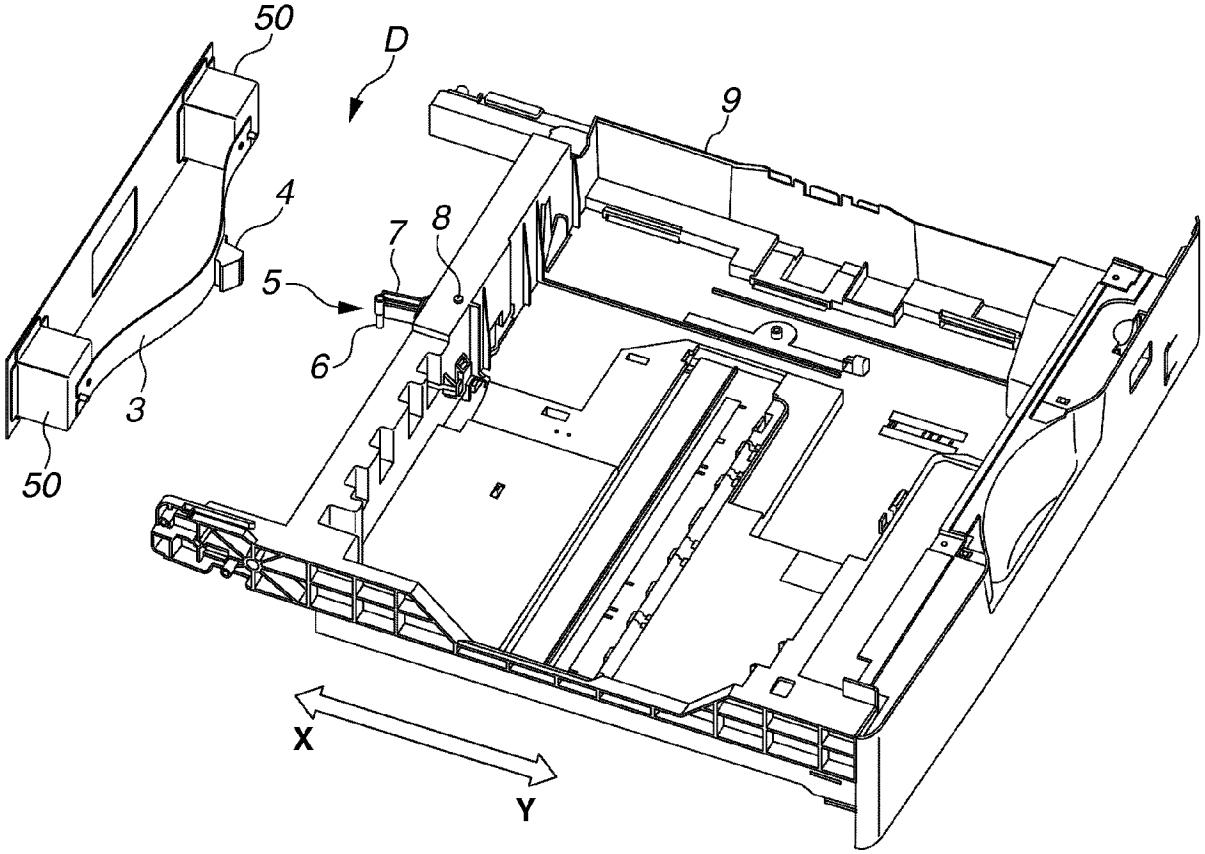
FIG. 1 illustrates a drawing apparatus according to a first exemplary embodiment.

Next, referring to the drawings, a first exemplary embodiment of a drawing apparatus D that is a feature of the present invention is described. In FIG. 1, the sheet feeding cassette 9 is a unit mountable and drawable to and from an apparatus body 1A. The drawing apparatus D draws the sheet feeding cassette 9 as the unit to a predetermined position of the apparatus body 1A to position it.

The drawing apparatus D includes an elastic leaf spring 3 that jump-buckles (snap-through buckles), an engaging unit 4 formed in the leaf spring 3, and an engaged unit 5 engaged with the engaging unit. The engaged unit 5 includes a pin 6 engaged with the engaging unit 4, an arm 7 for swingably supporting the pin 6, and a rotary shaft 8 for rotatably supporting the arm 7. In this exemplary embodiment, the leaf spring 3 including the engaging unit 4 is fixed to the apparatus body 1A, and the engaged unit 5 is fixed to the sheet feeding cassette 9.

As illustrated in FIG. 1, in a state where the sheet feeding cassette 9 has been pulled out from the apparatus body 1A, both ends of the leaf spring 3 are bent being supported by two-ends supporting units 50 disposed in the apparatus body 1A. The engaging unit 4 is disposed along the leaf spring 3.

The leaf spring 3 is elastically deformed when a force is applied to the apparatus body 1A in a loading direction X or a pulling-out direction Y of the sheet feeding cassette 9. Since it is supported in the bent state, the leaf spring 3 jump-buckles and is deformed in a force-applied direction when the force applied in the loading direction X or the pulling-out direction Y exceeds a certain limit.

In the present invention, the jump buckling means a phenomenon, where a force is applied to a bent elastic member from the outside, and when the force becomes equal to or more than the certain limit, the elastic member is suddenly deformed even without applying any more force, and curved in a force-applied direction (direction reverse to the bending direction). The deformation by the jump buckling is elastic deformation, and when a force is applied in the reverse direction, the elastic member deformed by the jump buckling, jump-buckles in the reverse direction.

As a material for the jump-buckling elastic member according to the present invention, spring stainless steel, spring beryllium copper/phosphor bronze/nickel silver can be used. A relatively thin sheet metal easily jump-buckles.

Next, referring to FIGS. 2A to 2E, FIGS. 2B to 2F, FIGS. 3A to 3E, and FIGS. 3B to 3F, loading and pulling-out operations of the sheet feeding cassette 9 on and from the apparatus body 1A by the drawing apparatus D are described. FIGS. 2A to 2E schematically illustrate an operation when the sheet feeding cassette 9 is loaded to a loading completion position that is a predetermined position of the apparatus body 1A. FIGS. 2B to 2F illustrate states of the pin 6, the leaf spring 3, and the engaging unit 4 corresponding to FIGS. 2A to 2E. FIGS. 3A to 3E schematically illustrate an operation of the drawing apparatus D when the sheet feeding cassette 9 is pulled out from the loading completion position of the apparatus body 1A. FIGS. 3B to 3F illustrate states of the pin 6, the leaf spring 3, and the engaging unit 4 corresponding to FIGS. 3A to 3E.

Figure 2A:
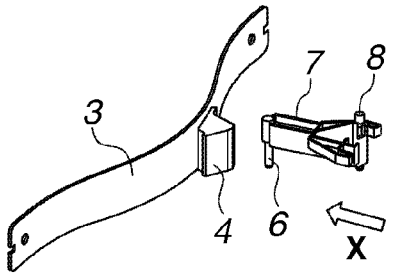
FIGS. 2A to 2F illustrate a unit drawing operation according to the first exemplary embodiment.

The operation of loading the sheet feeding cassette 9 on the apparatus body 1A is described. When the sheet feeding cassette 9 is inserted in the loading direction X, as illustrated in FIG. 2C, the pin 6 changes from a position 6*a* to a position 6*b* to abut on the engaging unit 4. When the sheet feeding cassette 9 is further inserted in the loading direction X, the pin 6 is guided by the engaging unit 4 to swing the arm 7, passes through a position 6*c*, and moves to a position 6*d* to abut on the leaf spring 3. FIG. 2A illustrates the moving positions 6*a*, 6*b*, 6*c*, and 6*d* of the pin 6.

Figure 2B:
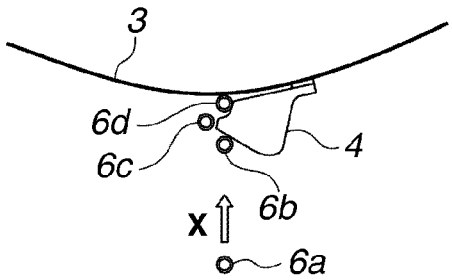
Figure 2C:
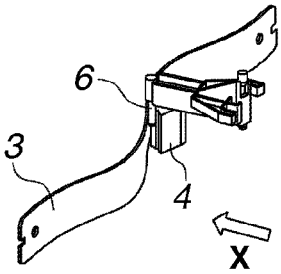
Figure 2D:
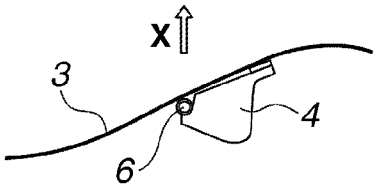
Figure 12A:
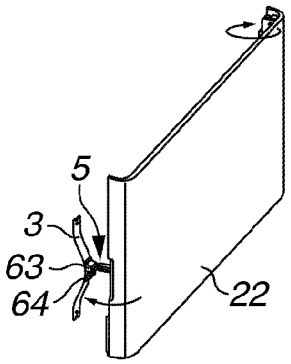
FIGS. 12A to 12I illustrate a unit drawing operation according to the fourth exemplary embodiment.
Figure 12B:
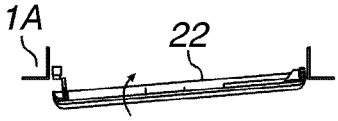

When the sheet feeding cassette 9 is further inserted in the loading direction X, the pin 6 pushes the leaf spring 3 toward a rear side plate of the apparatus body 1A, and accordingly the leaf spring 3 is elastically deformed in the loading direction X until the state illustrated in FIG. 12B or FIG. 2D is set. When the sheet feeding cassette 9 is further inserted in the loading direction X from the state illustrated in FIG. 2C or FIG. 2D, and a force applied to the leaf spring 3 becomes equal to or more than the certain limit, the leaf spring 3 is deformed by jump buckling in the loading direction X to be set to the state illustrated in FIG. 2E or FIG. 2F. FIG. 2F illustrates the drawn and loaded state of the sheet feeding cassette 9 by the drawing apparatus D.

During the deformation of the leaf spring 3 by the jump buckling, a drawing force is generated in the loading direction X. When the leaf spring 3 jump-buckles from the state illustrated in FIG. 2C or FIG. 2D to the state illustrated in Fir. 2E or FIG. 2F. The engaging unit 4 and the pin 6 are kept engaged, and thus the sheet feeding cassette 9 is drawn into the apparatus body 1A via the engaging unit 4 and the engaged unit 5.

Generally, the image forming apparatus includes a positioning mechanism for positioning the units in the loading direction of the apparatus body. As illustrated in FIG. 6, the positioning mechanism according to this embodiment includes a contact member 9*a* disposed in the sheet feeding cassette 9, and a reference member 21 disposed in the apparatus body 1A. By loading the sheet feeding cassette 9 on the apparatus body 1A and bringing the contact member 9*a* into contact with the reference member 12, the sheet feeding cassette 9 is positioned in the loading direction.

In the positioned state of the sheet feeding cassette 9 by the positioning mechanism, the deformation of the leaf spring 3 by the jump buckling is stopped in the midway. When the sheet feeding cassette 9 is not positioned by the positioning mechanism, as illustrated in FIG. 2F, the leaf spring 3 is deformed by jump buckling to a state indicated by dotted lines. Thus, in the loaded state in the apparatus body 1A, the sheet feeding cassette 9 is in the position where the deformation of the leaf spring 3 by the jump buckling is stopped in the midway by the positioning mechanism. The leaf spring 3 accordingly applies a force of the loading direction X to the sheet feeding cassette 9, and the sheet feeding cassette 9 is pressed in the drawing direction. As a result, the sheet feeding cassette 9 is surely set in the loading completion position of the apparatus body 1A.

Figure 2E:
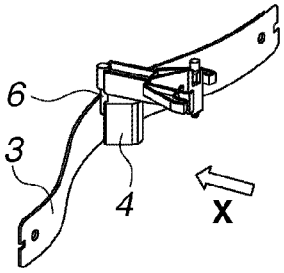
Figure 2F:
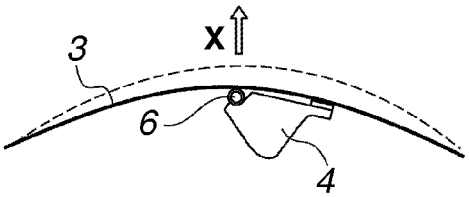

Specifically, when the user inserts the sheet feeding cassette 9 into the apparatus body 1A in the loading direction X, and the force equal to or more than the certain limit is applied to the leaf spring 3, the sheet feeding cassette 9 is drawn by the jump buckling of the leaf spring 3 to the state that is the loading completion position illustrated in FIG. 2E. As a result, the sheet feeding cassette 9 can surely be positioned with respect to the apparatus body. On the other hand, when the force applied to the leaf spring 3 by the insertion of the sheet feeding cassette 9 is less than the certain limit, the elastically deformed leaf spring 3 returns to the state illustrated in FIG. 2A, and thus the user never falsely recognizes that the sheet feeding cassette 9 is loaded.

Figure 3A:
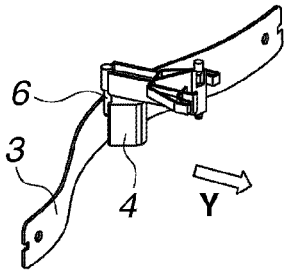
FIGS. 3A to 3F illustrate a unit drawing operation according to the first exemplary embodiment.
Figure 3B:
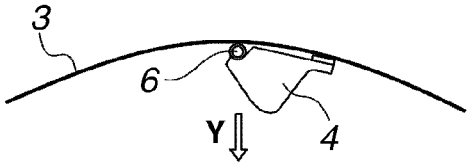
Figure 3C:
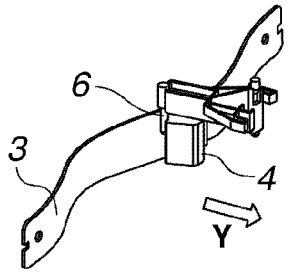
Figure 3D:
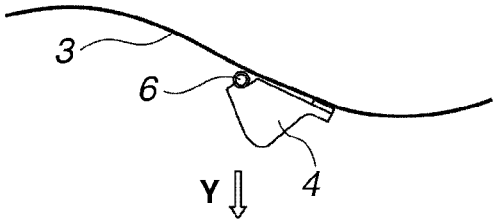

Next, referring to FIGS. 3A to 3E and FIGS. 3B to 3F, the pulling-out operation of the sheet feeding cassette 9 from the loaded state in the apparatus body 1A by the drawing apparatus D is described. When the sheet feeding cassette 9 set at a loading completion position illustrated in FIG. 3C or FIG. 3B starts to be pulled out, as illustrated in FIG. 3C or FIG. 3D, the pin 6 of the engaged unit 5 engaged with the engaging unit 4 elastically deforms the leaf spring 3 in the pulling-out direction Y.

Figure 3E:
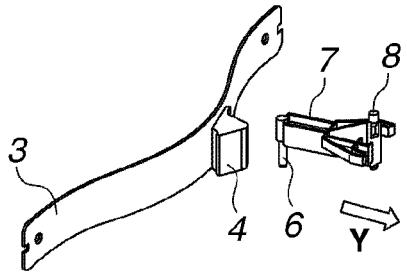
Figure 3F:
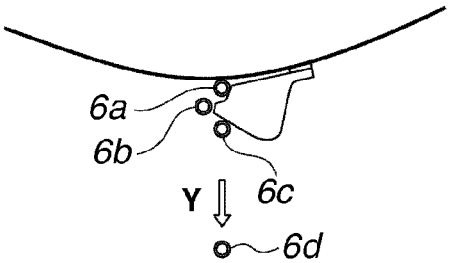

When the sheet feeding cassette 9 is further pulled out in the pulling-out direction Y from the state illustrated in FIG. 3C or FIG. 3D, a force applied to the leaf spring 3 becomes equal to or more than a certain limit, and accordingly the leaf spring 3 jump-buckles in the pulling-out direction Y opposite to that when the leaf spring 3 is inserted, and is set to a state illustrated in FIG. 3E or FIG. 3F.

During the jump buckling of the leaf spring 3, a drawing force is generated in the pulling-out direction Y. When the leaf spring 3 jump-buckles from the state illustrated in FIG. 3C or FIG. 3D to the state illustrated in Fir. 3E or FIG. 3F, the engaging unit 4 and the pin 6 are kept engaged, and thus the sheet feeding cassette 9 is pulled out via the engaging unit 4 and the engaged unit 5.

As illustrated in FIG. 3F, during the process of the jump buckling of the leaf spring 3 from the state illustrated in FIG. 3C to the state illustrated in FIG. 3E, the pin 6 is guided by the engaging unit 4 to swing the arm 7, and sequentially swings from a position 6*a* to a position 6*b* and a position 6*c*. Then, after the jump buckling, the pin 6 is disengaged from the engaged unit to be set in a position 6*d*.

As described above, according to the drawing apparatus D of the first exemplary embodiment, the unit can surely be positioned in the apparatus body A by utilizing the jump buckling phenomenon of the elastic member. Further, the direction of the force generated by the jump buckling of the elastic member is similar to the unit drawing direction. Thus, different from the case of the drawing apparatus using the toggle mechanism, there is no need to separately provide any swinging member or any guiding member. The number of components can be reduced, and the unit can be drawn into the apparatus body with a simple configuration.

Figure 4:
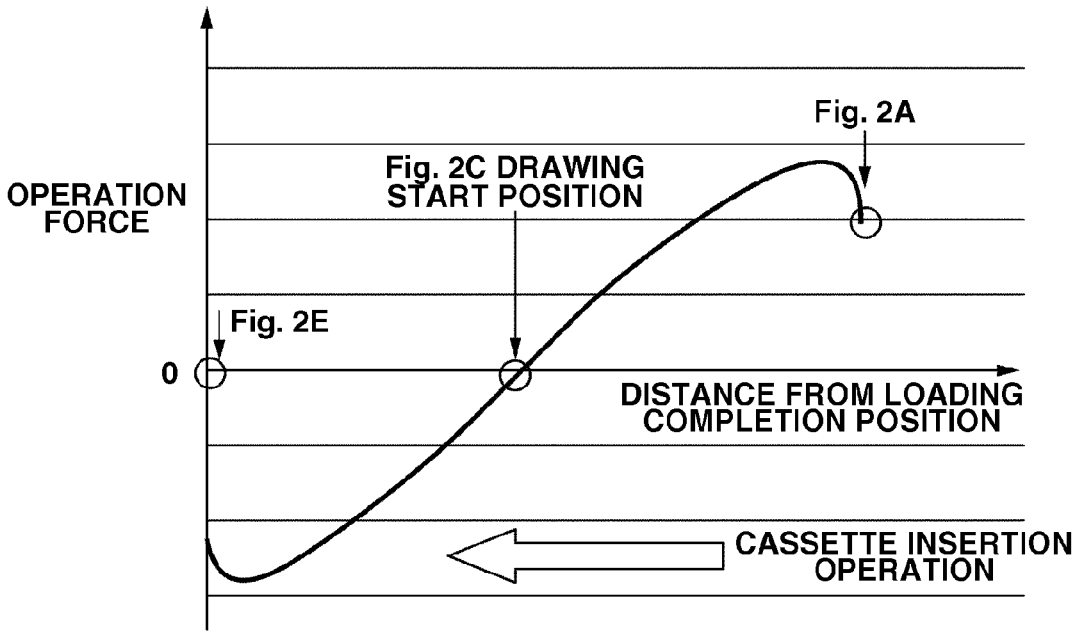
FIG. 4 illustrates an operation force of a unit loading operation.

FIG. 4 illustrates an operation force of the leaf spring 3 in the loading and pulling-out operations of the sheet feeding cassette 9. A vertical axis indicates a force applied to the sheet feeding cassette 9 by the leaf spring 3, while a horizontal axis indicates a distance of the sheet feeding cassette 9 from the loading completion position of the apparatus body 1A. When the operation value takes a positive value, the leaf spring 3 applies a force of pushing out the sheet feeding cassette 9 in the pulling-out direction Y. When it takes a negative value, the leaf spring 3 applies a force of drawing the sheet feeding cassette 9 in the loading direction X.

Specifically, when the distance of the sheet feeding cassette 9 from the loading completion position is as shown in FIG. 2A to FIG. 2C, the operation force is positive in value, and thus the user who inserts the sheet feeding cassette 9 needs a force to squeeze the sheet feeding cassette 9 in the loading direction X. When the distance of the sheet feeding cassette 9 from the loading completion position is as shown in FIG. 2C to FIG. 2E, the operation force is negative in value, and thus the sheet feeding cassette 9 is drawn in the loading direction X without user's squeezing by hand.

Figure 7:
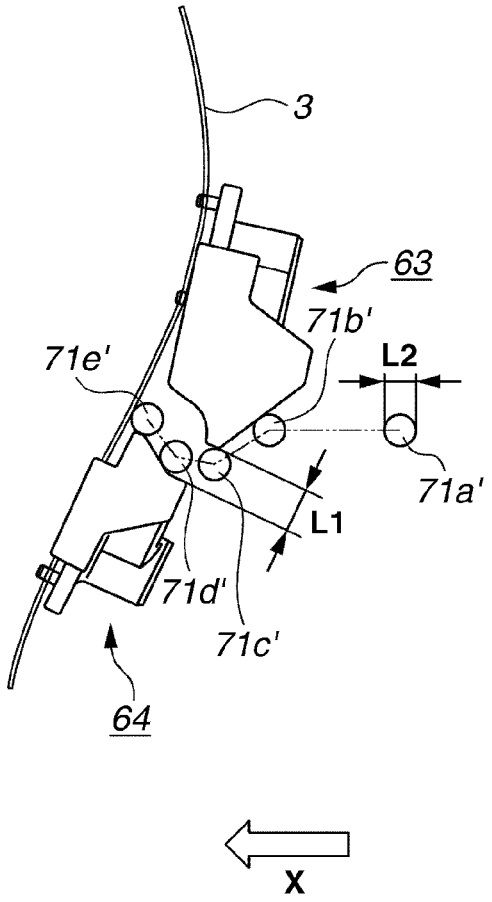
FIG. 7 illustrates a drawing apparatus according to a second exemplary embodiment.

Next, a drawing apparatus D according to a second exemplary embodiment of the present invention is described. In the drawing apparatus D according to the second exemplary embodiment, only an engaging unit disposed in an elastic member is different from that of the first exemplary embodiment. Other components are similar to the first exemplary embodiment, and thus description thereof is omitted. As illustrated in FIG. 7, the drawing apparatus D according to the second exemplary embodiment includes two engaging units, namely, a first engaging unit 63 and a second engaging unit 64. A leaf spring 61 is an elastic member.

Figure 8:
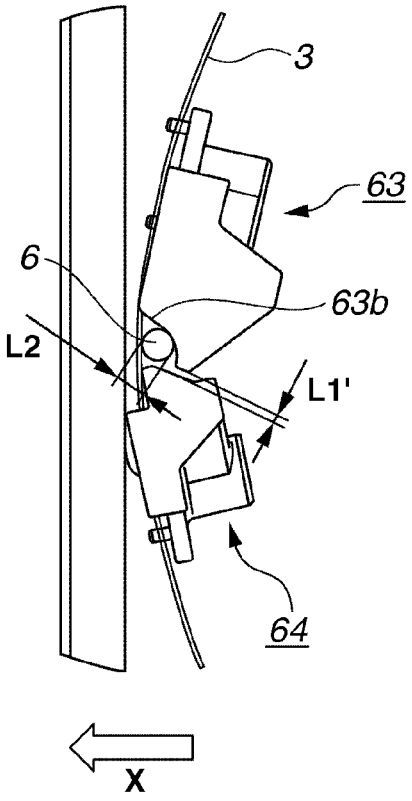
FIG. 8 illustrates the drawing apparatus according to the second exemplary embodiment.

As illustrated in FIG. 8, in a state where a sheet feeding cassette is loaded as a unit, the first engaging unit 63 and the second engaging unit 64 sandwich a pin 6 disposed as an engaged unit in the sheet feeding cassette, from both sides. Therefore, in the drawing apparatus D according to the second exemplary embodiment, the pin 6 is hardly removed from the engaging units by shocks. Hereinafter, the engaging units of the second exemplary embodiment are described in detail.

As illustrated in FIG. 7, in a state where the unit is not loaded, the first engaging unit 63 and the second engaging unit 64 are spaced from each other by a gap L1. On the other hand, the pin 6 has a width L2. Both are configured to have a relationship of L1>L2.

Next, operations of the first engaging unit 63 and the second engaging unit 64 and the pin 6 disposed in the engaged unit when the sheet feeding cassette 9 as a unit is loaded on an apparatus body 1A are described.

As illustrated in FIG. 7, when the sheet feeding cassette is inserted in a loading direction X, the pin 6 moves from a position 71*a*' to a position 71*b*' to abut on the first engaging unit 63. When the sheet feeding cassette is further inserted in the loading direction X, the pin 6 passes through a position 71*c*' of the first engaging unit 63 to abut on a position 71*d*' of the second engaging unit 64. When the sheet feeding cassette is further inserted in the loading direction X, the pin 6 moves to a position 71*e*' to abut on a leaf spring 3.

When the sheet feeding cassette is further inserted in the loading direction X, the pin 6 squeezes the leaf spring 3 in the loading direction X, and the leaf spring 3 is deformed in the loading direction X. When a force applied to the leaf spring 3 becomes equal to or more than a certain limit, the leaf spring 3 is deformed by jump buckling in the loading direction X to a state illustrated in FIG. 8. FIG. 8 illustrates the loaded state of the sheet feeding cassette on the apparatus body.

In the loaded state of the unit, the gap L between the first engaging unit and the second engaging unit is shorter than the width L2 of the pin 6. Since the pin 6 is hard to be removed even when shocks occur, the drawing apparatus D according to the second exemplary embodiment can provide an effect of preventing erroneous operations (such as drawing failure).

Next, a drawing apparatus D according to a third exemplary embodiment of the present disclosure is described. The drawing apparatus D according to the third exemplary embodiment is different from that of the second exemplary embodiment only in inclusion of a bending restriction unit 65 configured to restrict bending of a leaf spring 3 that is an elastic member. Other components are similar to those of the second exemplary embodiment, and thus description thereof is omitted.

Figure 9:
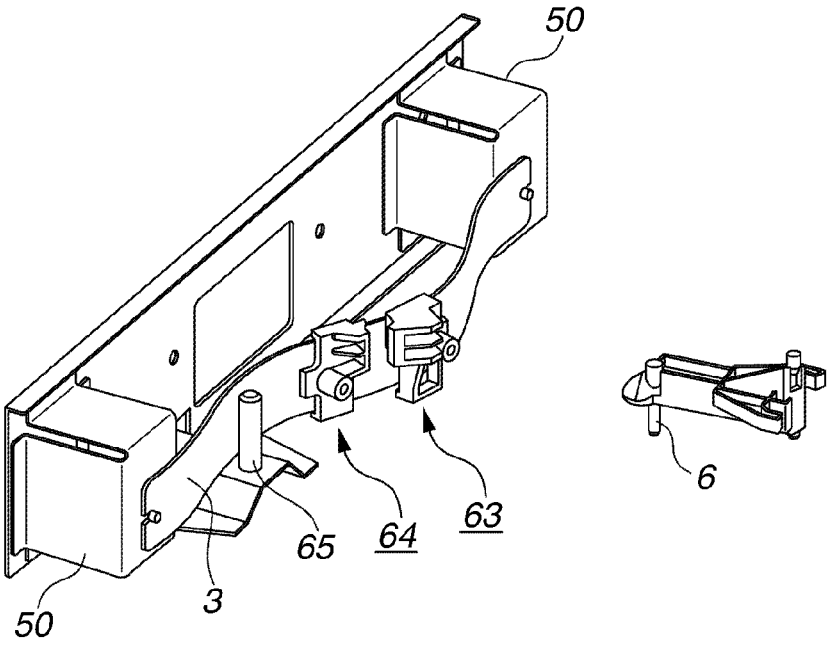
FIG. 9 illustrates a drawing apparatus according to a third exemplary embodiment.

As illustrated in FIG. 9, the drawing apparatus D according to the third exemplary embodiment includes the bending restriction unit 65 configured to support the elastic member to restrict its bending at a position between one of two-ends supporting units 50, and a second engaging unit 64.

Figure 10:
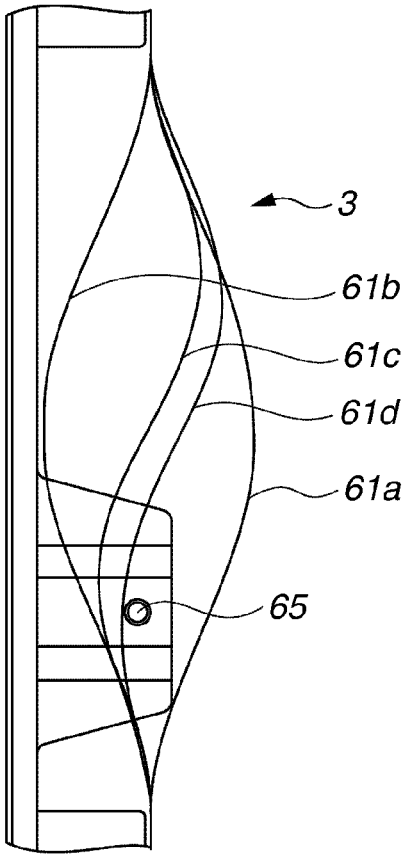
FIG. 10 illustrates motion of a leaf spring of the drawing apparatus according to the present disclosure.

FIG. 10 illustrates motion of the leaf spring 3 that is the elastic member. States 61*a* to 61*d* indicate states of the leaf spring 3. In FIG. 10, no engaging unit is illustrated.

In FIG. 10, the state 61*a* corresponds to a shape of the leaf spring 3 according to the second exemplary embodiment in a state where the sheet feeding cassette is not loaded. The state 61*b* corresponds to a shape of the leaf spring 3 according to the third exemplary embodiment in a state where the sheet feeding cassette is not loaded. In other words, in the third exemplary embodiment, the bending restriction unit 65 supports the leaf spring 3 by restricting its bending to the state 61*b* which is more restricted than the state 61*a*.

The state 61*c* illustrates a state immediately before the leaf spring 3 jump-buckles in a loading direction X, and the state 61*d* is a state after the leaf spring 3 has jump-buckled in the loading direction X.

As described above, according to the drawing apparatus D of the third exemplary embodiment, the bending of the elastic member is restricted by the bending restriction unit 65, so that the leaf spring 3 can be set to the state 62*b* near the state 61*c* immediately before its jump buckling.

As a result, the drawing apparatus D of the third exemplary embodiment can reduce a force necessary until the leaf spring 3 jump-buckles, by eliminating a force necessary for squeezing the leaf spring 3 from the state 61*a* to the state 61*b*. Thus, the necessary force when the user loads the unit can be reduced, and usability can be improved for the user who loads or unloads the unit.

Next, a drawing apparatus D according to a fourth exemplary embodiment is described. The drawing apparatus D according to the fourth exemplary embodiment is different from the second exemplary embodiment in that the unit is a door unit openable and closeable in an apparatus body. Other components are similar to those of the second exemplary embodiment.

Figure 11A:
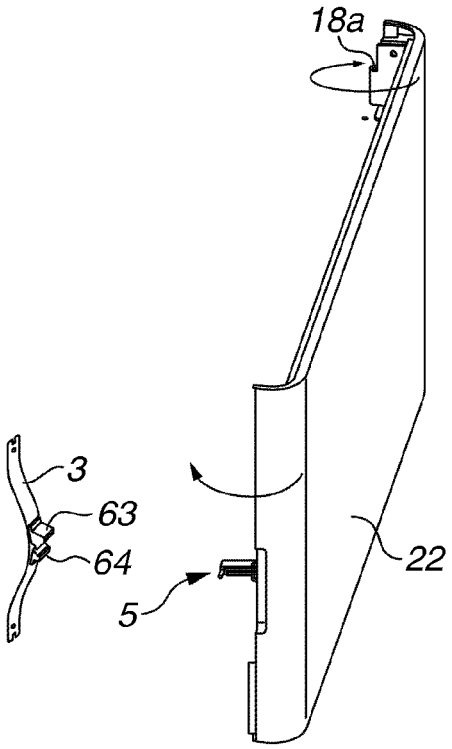
FIGS. 11A to 11C illustrate a drawing apparatus according to a fourth exemplary embodiment.
Figure 11B:
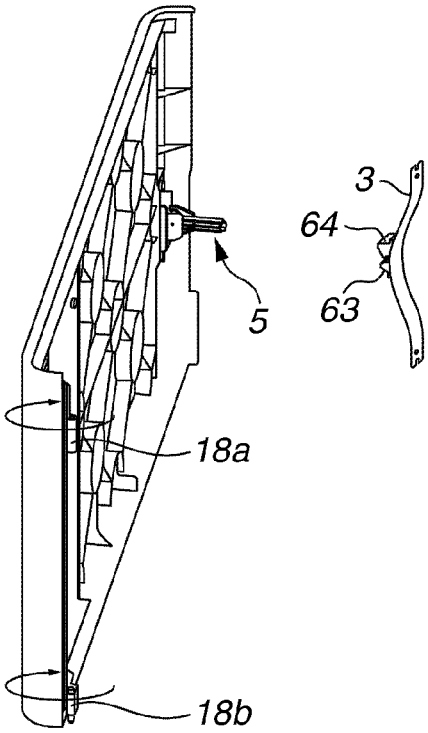
Figure 11C:
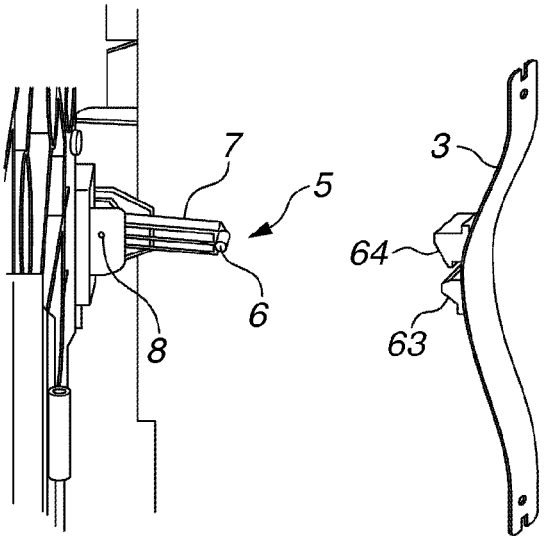

FIG. 11A illustrates a door unit 22 loadable and openable/closeable to the apparatus body. As in the case of the first to third exemplary embodiments, a leaf spring 3 that is an elastic member and jump-buckles, is fixed to the apparatus body 1A (not illustrated). The leaf spring 3 includes a first engaging unit 63 and a second engaging unit 64. The door unit 2 includes, on its rear surface, an arm 7 including a locking pin 6 and a rotary shaft 8. As illustrated in FIGS. 11A and 11B, the door unit 22 is rotatable around shafts 18*a* and 18*b* with respect to the apparatus body 1A. FIG. 11C is an enlarged view showing the drawing apparatus D according to the fourth exemplary embodiment.

Next, referring to FIGS. 12A to 12I and FIGS. 13A to 13I, operations of opening and closing the door unit 2 in the apparatus body 1A are described.

First, referring to FIGS. 12A to 12I, the operation of closing the door unit 22 from its open state to a loading completion position is described.

Figure 12C:
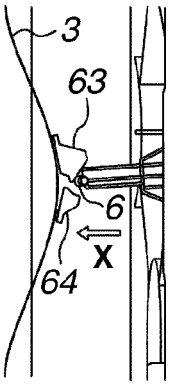
Figure 12D:
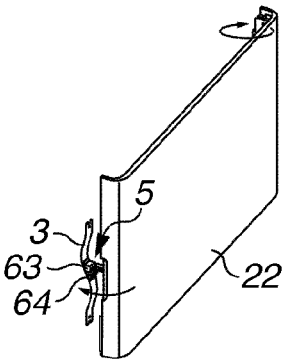
Figure 12E:
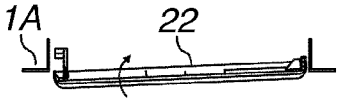
Figure 12F:
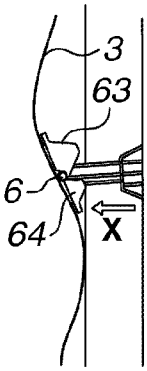
Figure 12G:
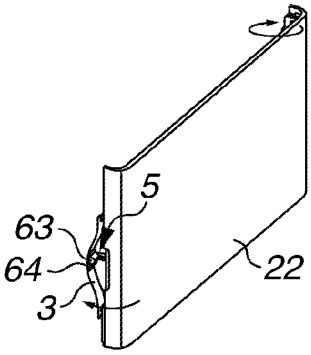
Figure 12H:
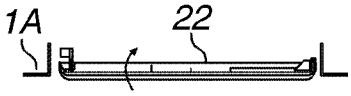
Figure 12I:
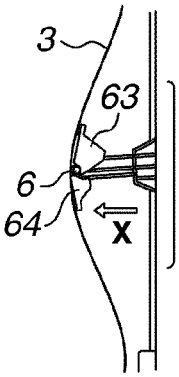

FIGS. 12A, 12D, and 12G schematically illustrate an operation when the door unit 22 is closed from the open state to the loading completion position that is a predetermined position of the apparatus body 1A. FIGS. 12B, 12E, and 12H are upper views illustrating the door unit 22 corresponding to the states illustrated in FIGS. 12A, 12D, and 12G. FIGS. 12C, 12F and 12I illustrate states of the locking pin 6, the leaf spring 3, the first engaging unit 63, and the second engaging unit 64 corresponding to the above states.

As illustrated in FIGS. 12A, FIG. 12B, or FIG. 12C, when the door unit 22 is pushed in a loading direction X and closed, the locking pin 6 abuts on the first engaging unit 63 because of downward tilting of the arm 7 by a gravitational force. When the door unit 22 is further pushed in the loading direction X, the locking pin 6 is guided by the second engaging unit 64 and the first engaging unit 63 to swing the arm 7, and then abuts on the leaf spring 3. When the door unit 22 is further pushed in the loading direction X, the locking pin 6 squeezes the leaf spring 3 in the loading direction X, and the leaf spring 3 is elastically deformed in the loading direction X until it is set to the state illustrated in FIG. 12D, FIG. 12E, or FIG. 12F.

When the door unit 22 is further pushed in the loading direction X, and a force applied to the leaf spring 3 becomes equal to or more than a certain limit, the leaf spring 3 is deformed by jump buckling in the loading direction X to the state illustrated in FIG. 12G, FIG. 12H, or FIG. 12I.

During the deformation of the leaf spring 3 by the jump buckling, a drawing force is generated in the loading direction X. When the leaf spring 3 jump-buckles from the state illustrated in FIG. 12D, FIG. 12E, or FIG. 12F to the state illustrated in FIG. 12G, FIG. 12H, or FIG. 12I, the first engaging unit 63 and the second engaging unit 64 and the pin 6 are kept engaged. Thus, the door unit 22 is drawn into the apparatus body 1A via the engaging units and the engaged unit.

In the drawing apparatus D according to the fourth exemplary embodiment, as in the case of the drawing apparatus D according to the first exemplary embodiment, the door unit 22 is surely positioned in the loading completion position of the apparatus body 1A by a positioning mechanism.

Next, referring to FIGS. 13A to 13I, the operation of opening the door unit 22 from its closed state in the loading completion position is described.

Figure 13A:
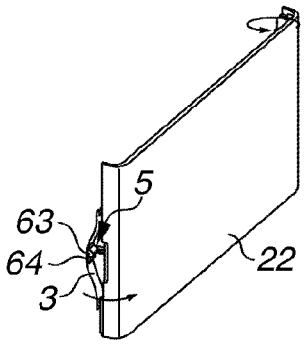
FIGS. 13A to 13I illustrate a unit drawing operation according to the fourth exemplary embodiment.
Figure 13B:
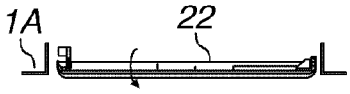
Figure 13C:
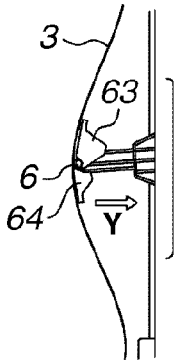
Figure 13D:
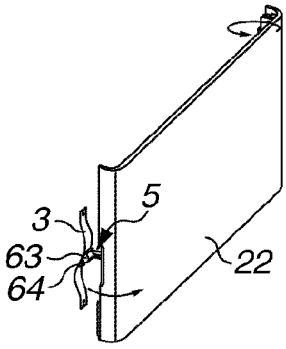
Figure 13E:
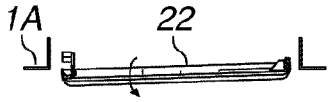
Figure 13F:
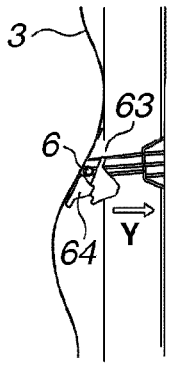
Figure 13G:
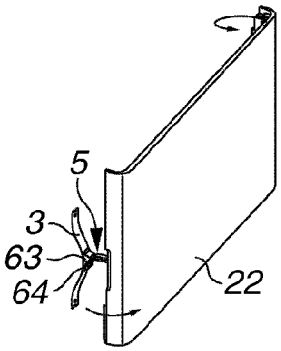
Figure 13H:
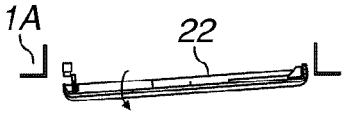
Figure 13I:
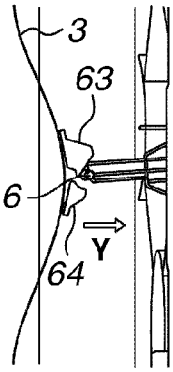

FIGS. 13A, 13D, and 13G schematically illustrate an operation when the door unit 22 is opened from the loading completion position that is the predetermined position of the apparatus body 1A. FIGS. 13B, 13E, and 13H are upper views illustrating the door unit 22 corresponding to the states illustrated in FIGS. 13A, 13D, and 13G. FIGS. 13C, 13F, and 13I illustrate states of the locking pin 6, the leaf spring 3, the first engaging unit 63, and the second engaging unit 64 corresponding to the above states.

When the door unit 22 is opened in a pulling-out direction Y from the loading completion position illustrated in FIGS. 13A, FIG. 13B, or FIG. 13C, as illustrated in FIG. 13D, FIG. 13E, or FIG. 13F, the locking pin 6 engaged with the first engaging unit 63 and the second engaging unit 64 elastically deforms the leaf spring 3 in the pulling-out direction.

When the door unit 22 is further opened in the pulling-out direction Y from the state illustrated in FIG. 13D, FIG. 13E, or FIG. 13F, a force applied to the leaf spring 3 becomes equal to or more than a certain limit. Then, the leaf spring 3 jump-buckles in the pulling-out direction Y that is opposite to that during the insertion, and is set to the state illustrated in FIG. 13G, FIG. 13H, or FIG. 13I.

During the jump buckling of the leaf spring 3, a force is generated in the pulling-out direction Y. When the leaf spring 3 jump-buckles from the state illustrated in FIG. 13D, FIG. 13E, or FIG. 13F to the state illustrated in FIG. 13G, FIG. 13H, or FIG. 13I, the first engaging unit 63 and the second engaging unit 64 and the pin 6 are kept engaged. Thus, the door unit 22 is pulled out via the engaging units and the engaged unit.

In the fourth exemplary embodiment, the configuration of the third exemplary embodiment can be applied.

As described above, according to the drawing apparatus D of the fourth exemplary embodiment using the door unit 22, as in the case of the drawing apparatus D according to the first exemplary embodiment, the unit can surely be positioned in the apparatus body with a simple configuration.

<Modified Example>

In the drawing apparatus D according to each of the first to fourth exemplary embodiments, the elastic member is disposed in the apparatus body 1A. However, the present invention is not limited to these exemplary embodiments. An elastic member that jump-buckles can also be disposed in the unit. Specifically, an elastic member can be disposed in the unit, and an engaged unit can be disposed in the apparatus body. When the elastic member is disposed in the unit, the engaged unit is disposed in the apparatus body 1A. In this case, when the unit is loaded on the apparatus body, an operation in which the engaging unit engages with the engaged unit, and the elastic body jump-buckles, thereby drawing the unit to a predetermined position of the apparatus body 1A, is similar to the first to fourth exemplary embodiments.

Figure 14A:
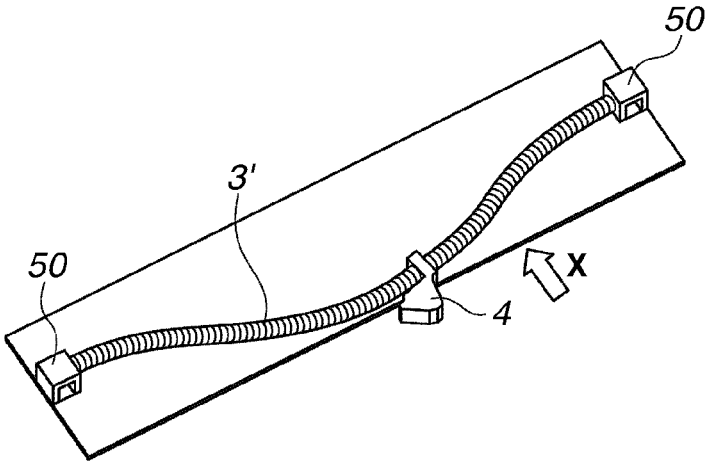
FIGS. 14A to 14C illustrate an example where the elastic leaf spring according to the first exemplary embodiment of the present disclosure is modified to be a coil spring.
Figure 14B:
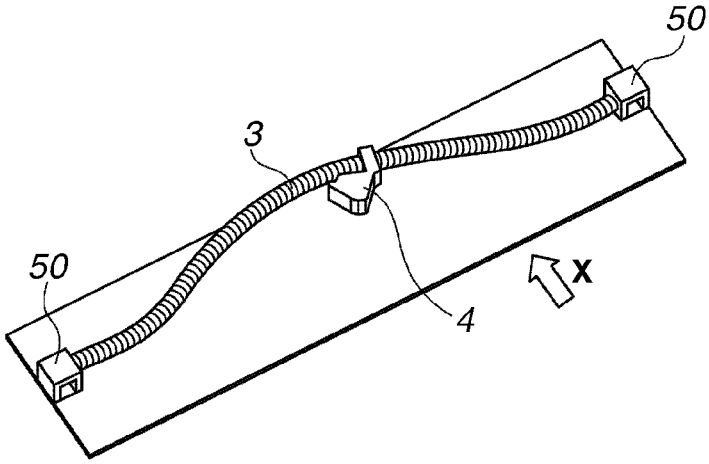

In the drawing apparatus D according to each of the first to fourth exemplary embodiments, the leaf spring is used for the elastic member. However, a coil spring 3' can be used as illustrated in FIG. 14A. FIG. 14A illustrates a state of the coil spring 3' and an engaging unit 4 before the unit is loaded. FIG. 14B illustrates a state where the unit is inserted in a loading direction X, and loaded on the apparatus body 1A (not illustrated). A configuration of an engaged unit 5 disposed on the unit side is similar to the first exemplary embodiment, and thus description and drawings thereof are omitted. Further, an operation in which the engaged unit engages with the engaging unit and the coil spring 3' and jump-buckles as an elastic member, is similar to the first exemplary embodiment, and thus description thereof is omitted.

Figure 14C:
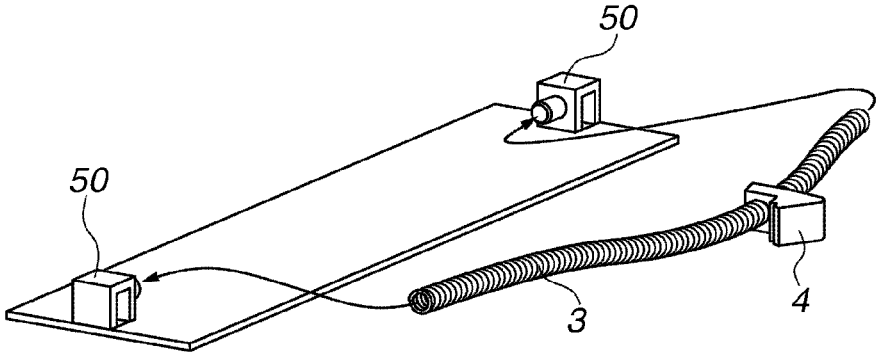
Figure 15:
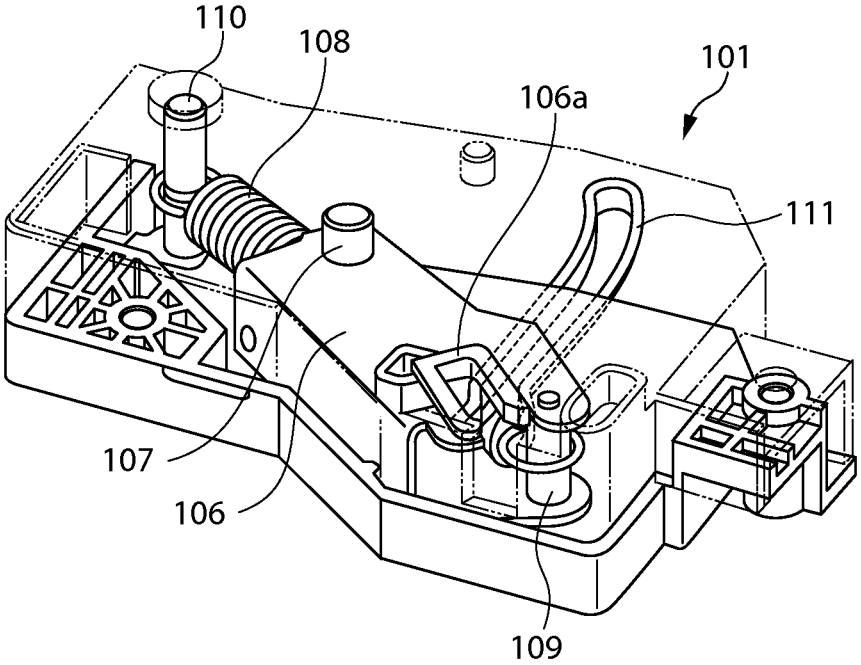
FIG.15 Prior Art
FIG. 15 illustrates the drawing apparatus of the invention discussed in Japanese Patent Application Laid-Open No. 2006-151687.
Figure 16:
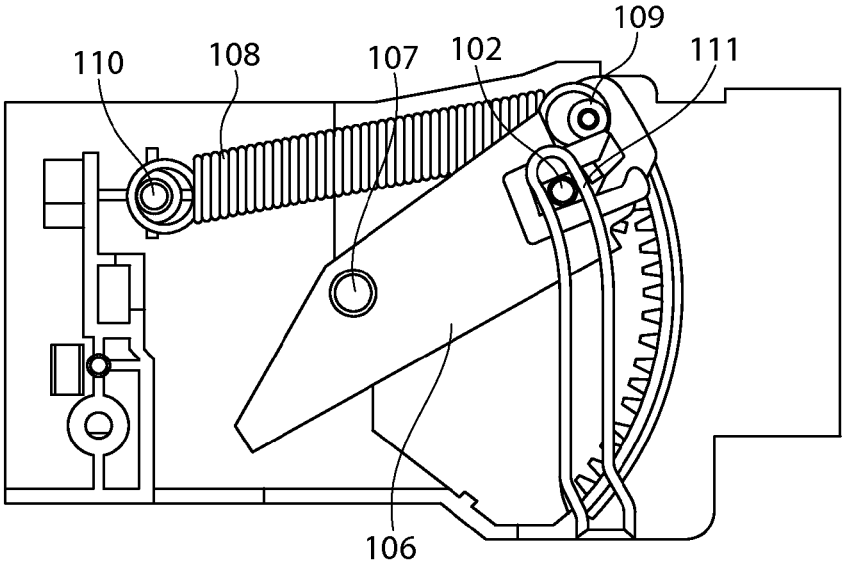
FIG.16 Prior Art
FIG. 16 illustrates the drawing apparatus of the invention discussed in Japanese Patent Application Laid-Open No. 2006-151687.

As illustrated in FIG. 14C, the coil spring 3' disposed in the engaging unit 4 is supported in a bent state by two-ends supporting units 50 of the apparatus body 1A. However, as in the case of the first to fourth embodiments, the coil spring 3' that is the elastic member can be disposed on the unit side. In such a case, the engaged unit is disposed in the apparatus body.

As the unit, the sheet feeding unit is used in the first to third exemplary embodiments, and the door unit is used in the fourth exemplary embodiment. However, the present invention is not limited to these embodiments. Instead of them, a transfer unit or a fixing unit can be used. Thus, the transfer unit or the fixing unit is drawn into the apparatus body to be surely positioned, and stable image forming processing can be carried out.

While the present disclosure has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-171999 filed Aug. 5, 2011, which is hereby incorporated by reference herein in its entirety.

What is claimed is:

1. A drawing apparatus used for an image forming apparatus and in combination with a unit and an apparatus body for drawing the unit loadable to and pullable from the apparatus body into a predetermined position of the apparatus body, comprising:

an elastic member disposed in the apparatus body;

an engaging unit disposed on the elastic member;

an engaged unit disposed on the unit and configured to engage with the engaging unit;

two end supporting units disposed in the apparatus body and configured to support both ends to bend the elastic member, and wherein when the unit is loaded on the apparatus body, the engaging unit engages with the engaged unit and the unit is drawn to the predetermined position of the apparatus body by deforming the elastic member from a state being bent so that the engaging unit is at a first side with respect to a line connecting both ends of the elastic member to a state being bent so that the engaging unit is at a second side that is an opposite side to the first side with respect to the line connecting both ends of the elastic member.

2. The drawing apparatus according to claim 1, further comprising a bending restriction unit disposed at a location between one of the two-ends supporting units and the engaging unit and configured to restrict the bending of the elastic member.

3. The drawing apparatus according to claim 1, further comprising a positioning mechanism configured to set the unit loadable to and pullable from the apparatus body in the predetermined position of the apparatus body, wherein in a state where the unit is set in the predetermined position of the apparatus body by the positioning mechanism, the elastic member is supported while deformation thereof caused by jump buckling is stopped in a midway position.

4. The drawing apparatus according to claim 1, wherein the elastic member is one of a sheet metal and a coil spring.

5. The drawing apparatus according to claim 1, wherein the engaging unit includes a guiding portion for guiding the engaged unit, and wherein when the unit is loaded on the apparatus body, the engaged unit engages with the engaging unit after contacting the guiding portion.

6. The drawing apparatus according to claim 1, wherein the engaging unit includes a first engaging unit and a second engaging unit, and wherein a gap between the first engaging unit and the second engaging unit in a state where the unit is loaded on the apparatus body is smaller than a gap between the first engaging unit and the second engaging unit in a state where the unit is not loaded on the apparatus body.

7. The drawing apparatus according to claim 1, wherein the engaged unit includes a pin engaged with the engaging unit, and an arm for swingably supporting the pin.

8. The drawing apparatus according to claim 7, wherein the engaging unit includes a first engaging unit and a second engaging unit, wherein a gap between the first engaging unit and the second engaging unit in a state where the unit is loaded on the apparatus body is smaller than a width of the pin, and wherein a gap between the first engaging unit and the second engaging unit in a state where the unit is not loaded on the apparatus body is larger than a width of the pin.

9. A drawing apparatus used for an image forming apparatus and in combination with a unit and an apparatus body for drawing the unit openable and closable in the apparatus body, into a predetermined position of the apparatus body, comprising:

an elastic member disposed on the apparatus body and configured to jump-buckle;

an engaging unit disposed on the elastic member;

an engaged unit disposed on the unit and configured to engage with the engaging unit; and two end supporting units disposed in apparatus, and configured to support both ends to bend the elastic member, wherein when the unit is closed toward the apparatus body, the engaging unit engages with the engaged unit and the unit engages with the engaged unit is drawn to the predetermined position of the apparatus body by deforming the elastic member from a state being bent so that the engaging unit is at a first side with respect to a line connecting both ends of the elastic member to a state being bent so that the engaging unit is at a second side that is an opposite side to the first side with respect to the line connecting both ends of the elastic member.

10. The drawing apparatus according to claim 9, further comprising a bending restriction unit disposed at a location between one of the two-ends supporting units and the engaging unit and configured to restrict the bending of the elastic member.

11. The drawing apparatus according to claim 9, further comprising a positioning mechanism configured to set the unit openable and closable to the apparatus body, in the predetermined position of the apparatus body, wherein in a state where the unit is set in the predetermined position of the apparatus body by the positioning mechanism, the elastic member is supported while deformation thereof caused by jump buckling is stopped in a midway position.

12. The drawing apparatus according to claim 9, wherein the elastic member is one of a sheet metal and a coil spring.

13. The drawing apparatus according to claim 9, wherein the engaging unit includes a guiding portion for guiding the engaged unit, and wherein when the unit is closed toward the apparatus body, the engaged unit engages with the engaging unit after contacting the guiding.

14. The drawing apparatus according to claim 9, wherein the engaging unit includes a first engaging unit and a second engaging unit, and wherein a gap between the first engaging unit and the second engaging unit in a state where the unit is closed toward the apparatus body is smaller than a gap between the first engaging unit and the second engaging unit in a state where the unit is not closed toward the apparatus body.

15. The drawing apparatus according to claim 9, wherein the engaged unit includes a pin engaged with the engaging unit, and an arm for swingably supporting the pin.

16. The drawing apparatus according to claim 15, wherein the engaging unit includes a first engaging unit and a second engaging unit, wherein a gap between the first engaging unit and the second engaging unit in a state where the unit is closed toward the apparatus body is smaller than a width of the pin, and wherein a gap between the first engaging unit and the second engaging unit in a state where the unit is not closed toward the apparatus body is larger than a width of the pin.

17. An image forming apparatus comprising:

an image forming portion configured to form an image;

a drawing apparatus used for the image forming apparatus and in combination with a unit and an apparatus body for drawing the unit loadable to and pullable from the apparatus body into a predetermined position of the apparatus body; the drawing apparatus comprising:

an elastic member disposed in the apparatus body;

an engaging unit disposed on the elastic member;

an engaged unit disposed on the unit and configured to engage with the engaging unit;

two ends supporting units disposed in the apparatus body and configured to support both ends to bend the elastic member, and wherein when the unit is loaded on the apparatus body, the engaging unit engages with the engaged unit and the unit is drawn to the predetermined position of the apparatus body by deforming the elastic member from a state being bent so that the engaging unit is at a first side with respect to a line connecting both ends of the elastic member to a state being bent so that the engaging unit is at a second side that is an opposite side to the first side with respect to the line connecting both ends of the elastic member.

18. An image forming apparatus comprising:

an image forming portion configured to form an image;

a drawing apparatus used for the image forming apparatus and in combination with a unit and an apparatus body for drawing the unit openable and closable in the apparatus body into a predetermined position of the apparatus body, the drawing apparatus comprising:

an elastic member disposed on the apparatus body;

an engaging unit disposed on the elastic member;

an engaged unit disposed on the unit and configured to engage with the engaging unit; and two ends supporting units disposed in the apparatus body and configured to support both ends to bend the elastic member, wherein when the unit is closed toward the apparatus body, the engaging unit engages with the engaged unit and the unit engages with the engaged unit is drawn to the predetermined position of the apparatus body by deforming the elastic member from a state being bent so that the engaging unit is at a first side with respect to a line connecting both ends of the elastic member to a state being bent so that the engaging unit is at a second side that is an opposite side to the first side with respect to the line connecting both ends of the elastic member.

* * * * *